US012414634B2

(12) United States Patent
Higgins

(10) Patent No.: US 12,414,634 B2
(45) Date of Patent: Sep. 16, 2025

(54) BED RAIL LOCKING SYSTEM AND METHOD

(71) Applicant: Cross Innovations LLC, Cheyenne, WY (US)

(72) Inventor: Shawn P. Higgins, Cheyenne, WY (US)

(73) Assignee: CROSS INNOVATIONS LLC, Cheyenne, WY (US)

( * ) Notice: Subject to any disclaimer, the term of this patent is extended or adjusted under 35 U.S.C. 154(b) by 85 days.

(21) Appl. No.: 18/583,601

(22) Filed: Feb. 21, 2024

(65) Prior Publication Data

US 2025/0261763 A1 Aug. 21, 2025

(51) Int. Cl.
*A47C 19/22* (2006.01)
*A47C 21/08* (2006.01)

(52) U.S. Cl.
CPC ..... *A47C 19/22* (2013.01); *A47C 21/08* (2013.01)

(58) Field of Classification Search
CPC ..... A47C 19/22; A47C 21/08
See application file for complete search history.

(56) References Cited

U.S. PATENT DOCUMENTS 7,334,957 B2 2/2008 Sadinsky et al.

FOREIGN PATENT DOCUMENTS

| | | | |
|---|---|---|---|
| CN | 216907422 | U | 7/2022 |
| CN | 115486667 | A | 12/2022 |
| CN | 116458741 | A | 7/2023 |
| GB | 1566914 | A | 5/1980 |

OTHER PUBLICATIONS

International Search Report and Written Opinion mailed May 19, 2025, Patent Application No. PCT/US2025/014204, 11 pages.

*Primary Examiner* — Adam C Ortiz
(74) *Attorney, Agent, or Firm* — Davis Wright Tremaine LLP

(57) ABSTRACT

A rail assembly comprising a locking assembly having a first body that defines a first body cavity and a pair of first body coupling holes, a second body that defines a second body cavity and a pair of second body tab holes, and a push pin disposed within the second body cavity. The push pin comprising a spring and tabs disposed within the second body cavity such that the tabs are configured to respectively extend through the first body coupling holes and through the second body tab holes. The locking assembly includes a stopper configured to be disposed proximate to or engaging the spring and/or tabs of the push pin such that the tabs of the push pin are physically prevented from being fully or partially pushable or retractable within the first body coupling holes and second body tab holes such that the first and second bodies are locked together and prevented from being disengaged, de-coupled or un-locked via the push pin.

18 Claims, 6 Drawing Sheets

195
134/184
484
410
450
150
480
455
484

195
134/184
420
410
450
150
415
480
455
420
451

195
134/184
420
410
411
425
420
415
412
484
460
450
150
452
480
486
486
482
451
460
484
455

BED RAIL LOCKING SYSTEM AND METHOD

Figure 1:
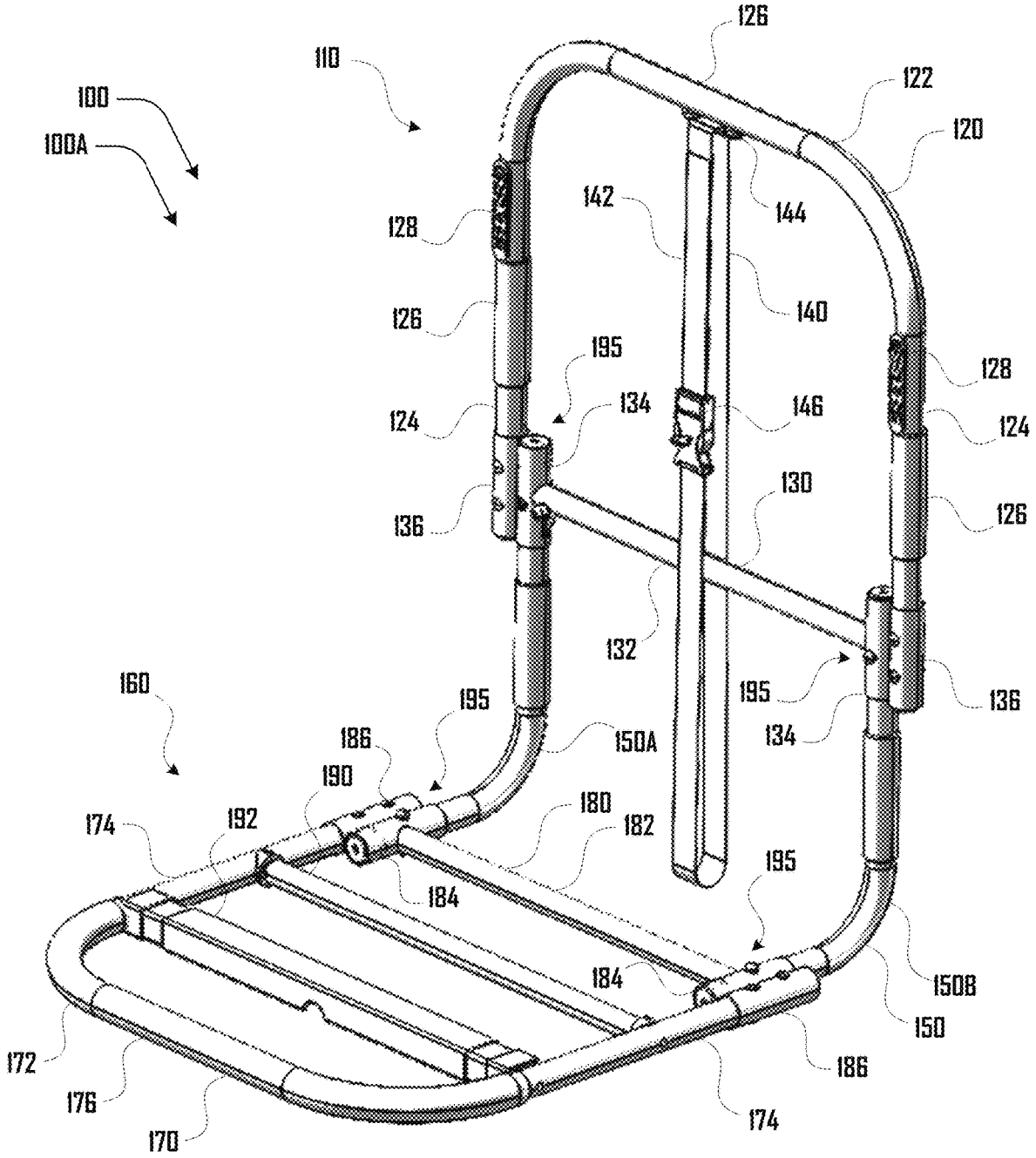
FIG. 1 illustrates a first example embodiment of a rail assembly in an assembled configuration.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Figure 2:
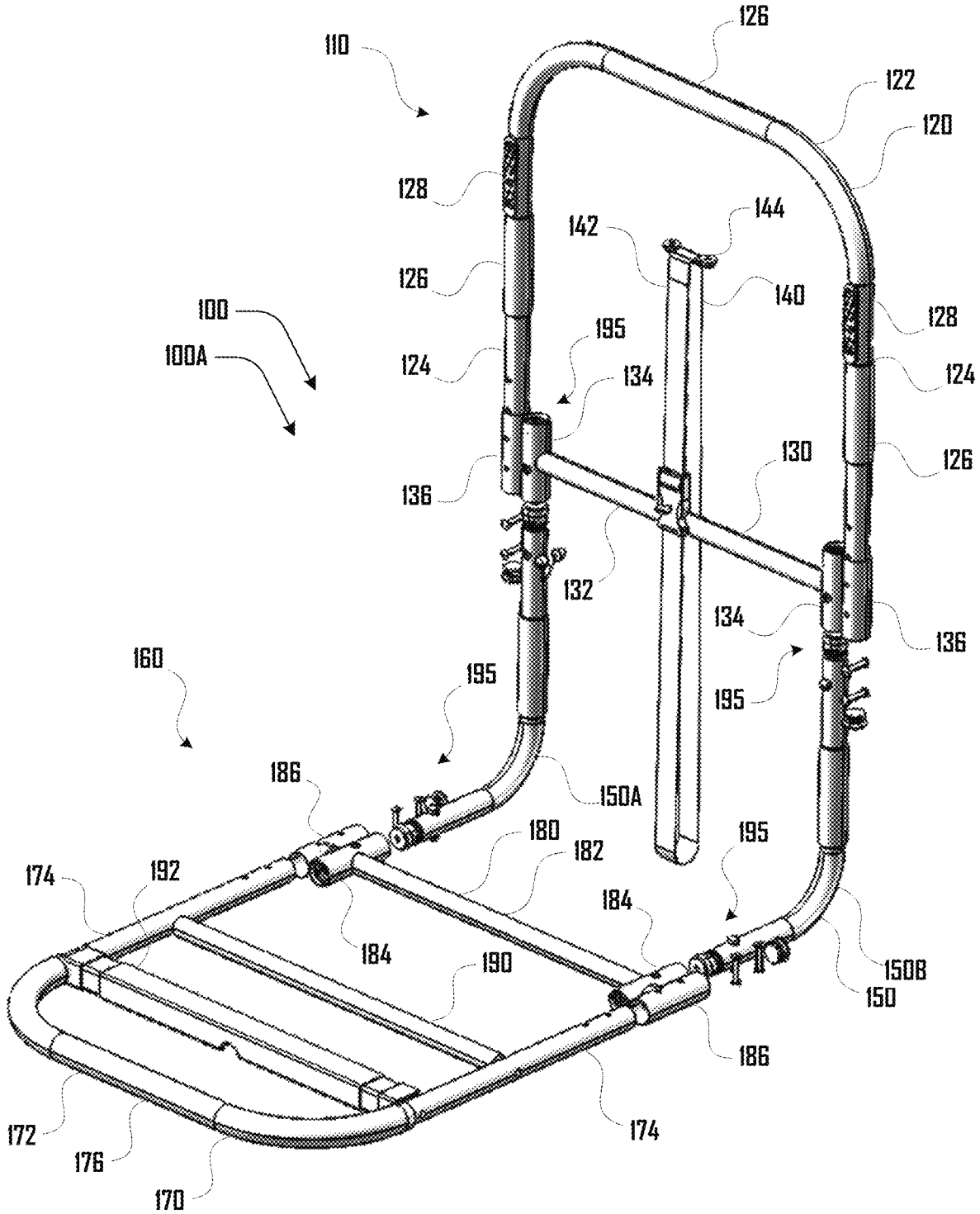
FIG. 2 illustrates the first example embodiment of the rail assembly in a disassembled configuration.
Figure 3:
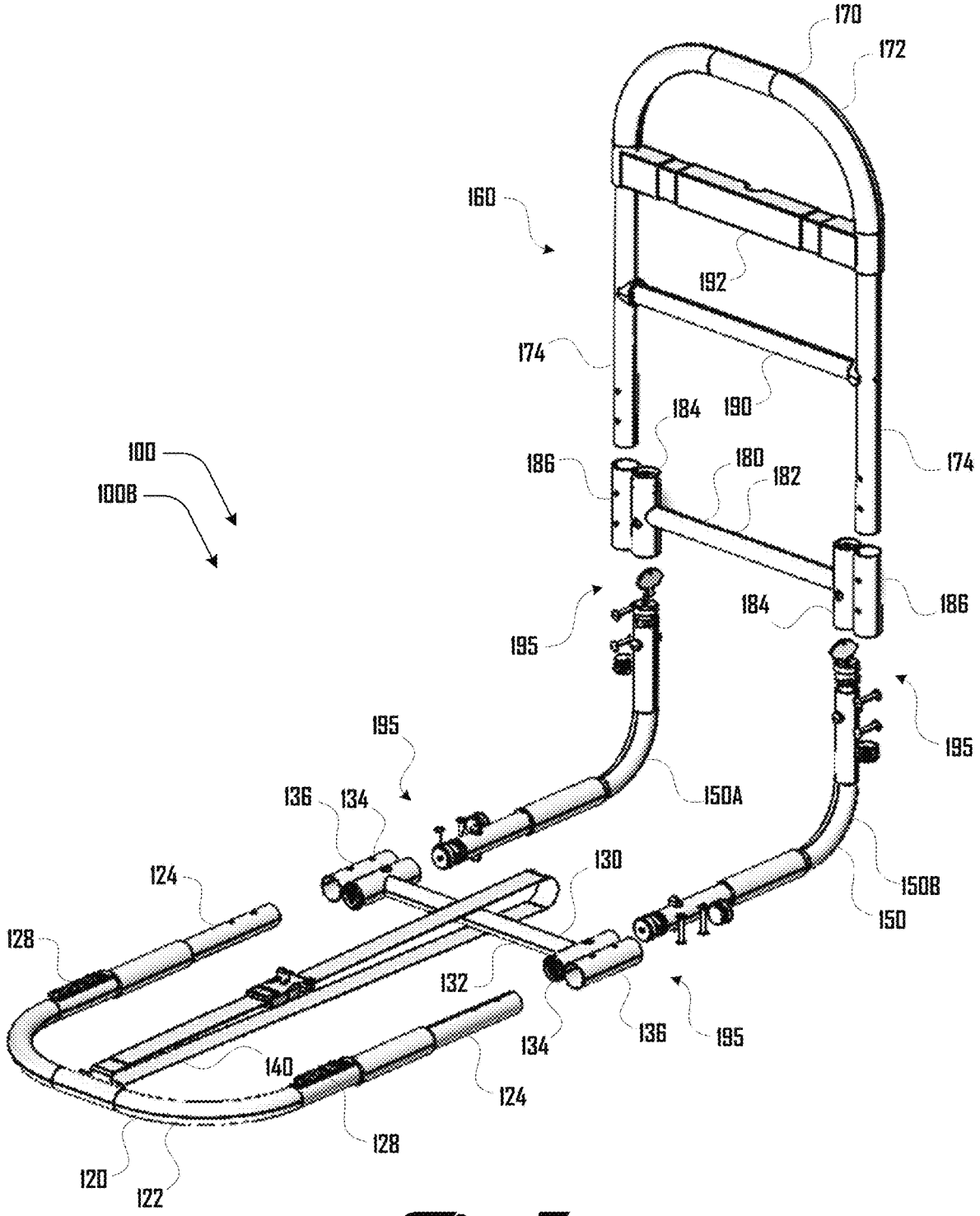
FIG. 3 illustrates a second example embodiment of a rail assembly in a disassembled configuration.

Turning to FIGS. 1-3, FIG. 1 illustrates a first example embodiment 100A of a rail assembly 100 in an assembled configuration, FIG. 2 illustrates the first example embodiment 100A of the rail assembly 100 in a disassembled configuration, and FIG. 3 illustrates a second example embodiment 100B of a rail assembly 100 in a disassembled configuration.

As shown in these examples, the rail assembly 100 comprises a first bar assembly 110 (e.g., an under-mattress bar assembly), which in this example includes a first U-bar 120 that is coupled to a first H-bar 130, and a strap assembly 140 coupled to an end of the first U-bar 120.

The rail assembly 100 further comprises a first and second L-bar 150A, 150B which are removably coupled to the first bar assembly 110 and removably coupled to a second bar assembly 160. The first and second bar assemblies 110, 160 can be generally planar along respective first and second bar assembly planes, with the first and second L-bar 150A, 150B holding the first and second bar assemblies 110, 160 such that the first and second bar assembly planes are perpendicular to each other. The second bar assembly 160 comprises a second U-bar 170 that is coupled to a second H-bar 180, a crossbar 190 and a device bar 192.

Returning to the first bar assembly 110, the first U-bar 120 comprises a first U-bar end 122 from which a pair of first U-bar sides 124 extend perpendicular to a central axis of the first U-bar end 122. The first U-bar 120 can comprise a set of one or more grips 126 (e.g., disposed on the first U-bar end 122 and first U-bar sides 124), which in some examples can comprise tubes of foam, rubber, silicone, plastic, or the like, that surround portions of the first U-bar 120. In various embodiments, the grips 126 can be soft elements where a user or other elements can grasp or otherwise interact with or engage the first U-bar 120. The first U-bar 120 can comprise a set of one or more pads 128 (e.g., disposed on the first U-bar sides 124), which in some examples can comprise textured plastic plates that provide points of friction engagement or coupling to a mattress, pad, bed, or the like, as discussed in more detail herein.

The first H-bar 130 can comprise a first H-bar beam 132 with a pair of first H-bar locking tubes 134 coupled on opposing ends of the first H-bar beam 132. A pair of first H-bar coupling tubes 136 can be respectively coupled to the first H-bar locking tubes 134 on an opposing side of where the first H-bar beam 132 is coupled to the first H-bar locking tubes 134. The first H-bar locking tubes 134 and first H-bar coupling tubes 136 can be disposed in parallel to each other and perpendicular to a central axis of the first H-bar beam 132. In various embodiments, the first H-bar coupling tubes 136 can couple with respective ends of the sides 124 of the first U-bar (e.g., via rivets, bolts, welding, or the like). In various embodiments, the first H-bar locking tubes 134 can be part of a locking assembly 195, which is discussed in more detail herein.

Turning to the second bar assembly 160, the second U-bar 170 comprises a second U-bar end 172 from which a pair of second U-bar sides 174 extend perpendicular to a central axis of the second U-bar end 172. The second U-bar 170 can comprise a set of one or more grips 176 (e.g., disposed on the second U-bar end 172), which in some examples can comprise one or more tubes of foam, rubber, silicone, plastic, or the like, which surround one or more portions of the second U-bar 170. In various embodiments, the grips 176 can be soft elements where a user or other elements can grasp or otherwise interact with or engage the second U-bar 170.

The second H-bar 180 can comprise a second H-bar beam 182 with a pair of second H-bar locking tubes 184 coupled on opposing ends of the second H-bar beam 182. A pair of second H-bar coupling tubes 186 can be respectively coupled to the second H-bar locking tubes 184 on an opposing side of where the second H-bar beam 182 is coupled to the second H-bar locking tubes 174. The second H-bar locking tubes 184 and second H-bar coupling tubes 186 can be disposed in parallel to each other and perpendicular to a central axis of the second H-bar beam 182. In various embodiments, the second H-bar coupling tubes 186 can couple with respective ends of the sides 174 of the second U-bar 170 (e.g., via rivets, bolts, welding, or the like). In various embodiments, the second H-bar locking tubes 184 can be part of a locking assembly 195, which is discussed in more detail herein.

In various embodiments, the crossbar 190 can be coupled with respective sides 174 of the second U-bar 170 (e.g., via rivets, bolts, welding, or the like). In various embodiments, the device bar 192 can be coupled with respective sides 174 of the second U-bar 170 (e.g., via rivets, bolts, welding, or the like) and can comprise various devices such as a light, alarm, computing device, or the like.

In various embodiments, elements of the first and second U-bars 120, 170, first and second H-bars 130, 180, and the like, can be made of various suitable materials such as metal, plastic, wood, or the like. Also, in various embodiments, such elements can be defined by hollow tubes or elements having any suitable configuration, so the examples of tubes or cylinders discussed herein should not be construed as limiting.

In various embodiments a rail assembly 100 can be coupled with a bed to provide a handrail for a user getting in and out of bed. For example, the first bar assembly 110 can be inserted between a mattress and bed frame with the second bar assembly 160 pushed against or proximate to the mattress and extending perpendicular to the face of the bed. The second bar assembly 160 can be sized in various embodiments to extend above the top face of the bed and provide a rail that a user can grasp to assist them in entering and exiting the bed or that can be used by assistants, doctors, nurses, caretakers, and the like.

In various embodiments, the weight of mattress can hold the first bar assembly 110 firmly in place such that the second bar assembly 160 provides a stable support rail. Additionally, various embodiments include a strap assembly 140 that can be used to secure the first bar assembly 110 to a mattress and/or bed. For example, the strap assembly 140 can comprise a strap 142 that loops through a slot 144 at the first U-bar end 122 of the U-bar 120, with the strap being configured to be releasably opened and closed via a clip 146. In some embodiments, the strap 142 can be looped around a bed frame and/or mattress, or the like, and secured via the clip 146 and tightened to secure the rail assembly 100 to the bed. In various embodiments, the pads 128 can engage the mattress to further secure the rail assembly 100 and prevent the rail assembly 100 from slipping out from under the mattress. While specific examples of a strap assembly 140, pads 128, and the like, are provided as elements for securing the rail assembly in various embodiments, these examples should not be construed to be limiting and various other suitable structures and elements can be employed to secure the rail assembly 100 such as rope, hook, adhesive, or the like.

Also, while some embodiments can be applicable to a bed with a mattress and a bed frame, it should be clear that various embodiments can be applicable to various types of beds, which may or may not have a mattress or bed frame, such as a mattress on the ground, a pad on a bed frame, or the like. For example, in some embodiments, the first bar assembly 110 can have a length such that the bar assembly will not extend out an opposing side of the bed where the rail assembly 100 is disposed between a mattress and bed frame (e.g., sized for a bed and/or mattress that is a twin, single, twin LX, full, double, queen, king, or the like, with a width such as 39, 54, 60, 66, 76, 80 inches, or the like, or a range between such example values). Additionally, in some embodiments, the second bar assembly 160 can be configured to extend above the face of a mattress or pad where the rail assembly 100 is disposed below a mattress or pad (e.g., a mattress or pad having a thickness of 4, 6, 8, 10, 12, 14, 16 inches or the like, or a range between such example values). The second bar assembly 160 can be configured to extend above the face of a mattress or pad various suitable amounts including 2, 4, 6, 8, 10, 12, 14, 16 inches or the like, or a range between such example values. The first and/or second bar assemblies 110, 160 can have various suitable widths, including a maximum width of 10.0, 10.5, 11.0, 11.5, 12.0, 12.5, 13.0, 13.5, 14.0, 14.5, 15.0, 15.5, 16.0, 16.5, 17.0, 17.5, 18.0, 18.5, 19.0 inches, or the like or a range between such example values. Also in examples where the first and/or second bar assemblies 110, 160 and L-bars 150 comprise cylindrical tubes, such cylindrical tubes can have a diameter of 0.5, 0.6, 0.7, 0.75, 0.8, 0.9, 1.0, 1.1, 1.2, 1.3, 1.4, 1.5, or the like or a range between such example values. Different parts of the first and/or second bar assemblies 110, 160 and L-bars 150 can have different diameters such as discussed herein.

Also, while some embodiments can be applicable to a bed, further embodiments can be applicable to a wide variety of other objects, furniture, or the like, such as a couch, chair, bench, or the like. Additionally, embodiments can be used in various locations such as a home, hospital, care facility, office, factory, car, boat, airplane or the like.

In various embodiments, it can be desirable for the rail assembly 100 to be assembled and disassembled. For example, as discussed in more detail herein, a plurality of locking assemblies 195 can be configured to allow the first and second bar assemblies 110, 160 to be disassembled from the first and second L-bars 150A, 150B. Note that while the examples of FIGS. 2 and 3 illustrate the first and second U-bars 120, 170 being disassembled from the coupling tubes 136, 186 of the first and second H-bars 130, 180, in some embodiments, the U-bars 120, 170 can be permanently or semi-permanently coupled with the coupling tubes 136, 186 of the first and second H-bars 130, 180 such as via welding, rivets, bolts, adhesive, friction fit, or the like.

Figures 4A, 4B, 4C:
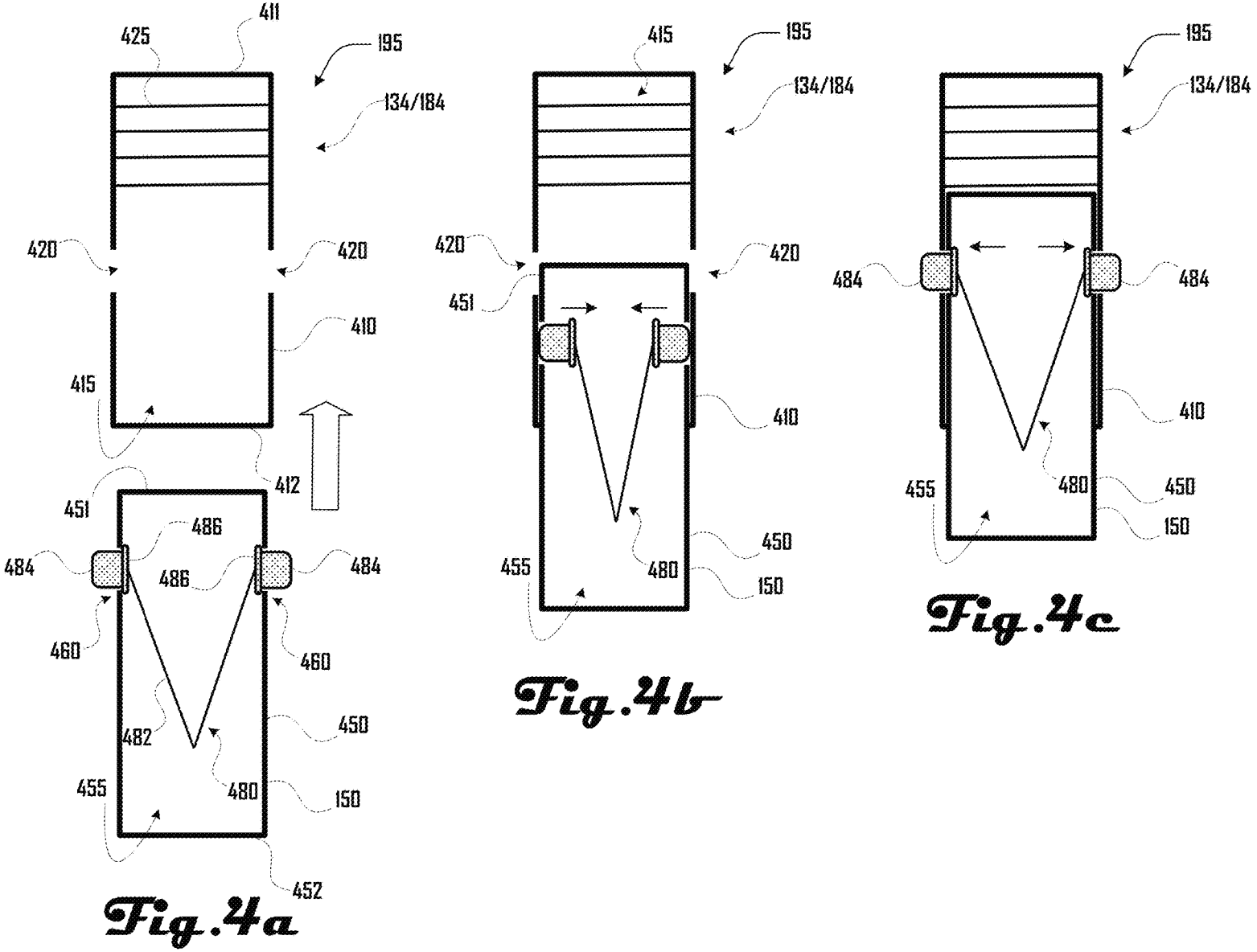
FIG. 4*a* is an example cross-sectional view of a first and second portion of a locking assembly.
FIG. 4*b* is an example cross-sectional view of the first and second portion of the locking assembly of FIG. 4*a* engaged in a first configuration.
FIG. 4*c* is an example cross-sectional view of the first and second portion of the locking assembly of FIGS. 4*a* and 4*b* engaged in a locked configuration.

Turning to FIGS. 4*a*, 4*b* and 4*c*, three configurations of portions of a locking assembly 195 are illustrated. In these examples, the locking assembly 195 comprises a first body 410, which can be defined by, or be a part of, a first or second H-bar locking tube 134, 184 in some embodiments. The first body 410 can be a cylindrical tube in various embodiments that extends between a first end 411 and second end 412 and defines a first body cavity 415 and a pair of first body coupling holes 420 on opposing sides of the first body 410. The first body 410 can comprise first body threads 425 at the first end 411.

The locking assembly 195 can further comprise a second body 450, which can be defined by, or be a part of, an L-bar 150 in some embodiments. The second body 450 can be a cylindrical tube in various embodiments that extends between a first end 451 and second end 452 and defines a second body cavity 455 and a pair of second body tab holes 460 on opposing sides of the second body 450.

The second body 450 can comprise a push pin 480 disposed within the second body cavity 455, with the push pin 480 comprising a spring 482 and a pair of tabs 484 that include a base flange 486. The spring 482 in various embodiments can be V-shaped with a pair of arms that have the tabs 484 coupled at the ends of the arms. The spring 482 can bias the tabs outward away from each other such that the tabs 484 respectively extend through the second body tab holes 460 and are stopped by the flanges 486 as shown in FIGS. 4*a* and 4*c*. While the spring 482 is shown as being V-shaped in this example, further embodiments can include a spring 482 of any suitable configuration or shape such as a U-shape, coil, or the like. Similarly, the tabs 484 can have any suitable configuration in further examples.

As shown in FIG. 4*c*, in various embodiments the push pin 480 can allow the first and second bodies 410, 450 to be locked together. For example, the second body 450 can have an external diameter that is equal to or slightly smaller than an internal diameter within the first body cavity 415 of the first body 410 such that the first end 451 of the second body 450 can be inserted into the first body cavity 415 at the second end 412 of the first body 410 with a close fit as shown in FIGS. 4*b* and 4*c*.

As shown in the example of FIG. 4*b*, inserting the first end 451 of the second body 450 into the first body cavity 415 at the second end 412 of the first body 410 can cause the tabs 484 to engage an internal wall of the second body 450 such that the tabs 484 retract within the second body tab holes 460 and be biased by the spring 482. The first end 451 of the second body 450 can be further extended within the first body cavity 415 at the second end 412 of the first body 410 until the tabs 484 align with the first body coupling holes 420 and the biasing of the tabs 484 via the spring 482 causes the tabs 484 to extend through the first body coupling holes 420 until the tabs 484 are stopped by the base flanges 486 of the tabs 484 as shown in FIG. 4*c*. Accordingly, the first and second bodies 410, 450 can be coupled or locked together via the tabs 484 extending through the aligned first body coupling holes 420 and second body tab holes 460 as shown in the example of FIG. 4*c*.

To disengage, de-couple or un-lock the first and second bodies 410, 450, in various embodiments, a user can depress the tabs 484 by squeezing them with their fingers to cause the tabs 484 to retract within first body coupling holes 420 and second body tab holes 460 such that the second body can be removed from the first body cavity 415 at the second end 412 of the first body 410 such as shown in FIGS. 4*b* and 4*a* respectively. Accordingly, in various embodiments the spring 482 can bias the tabs with sufficient force to bias the tabs 484 outward as discussed herein and an amount of force that would allow a user to pinch the tabs 484 as discussed herein.

Turning to FIGS. 5*a-d*, in various embodiments a locking assembly 195 can comprise a stopper 500 that can be configured to lock the push pin 480 such that the tabs 484 of the push pin 480 are physically prevented from being pushable or retractable within the first body coupling holes 420 and second body tab holes 460 such that the first and second bodies 410, 450 are prevented from being disengaged, de-coupled or un-locked.

Figures 5A, 5B, 5C, 5D:
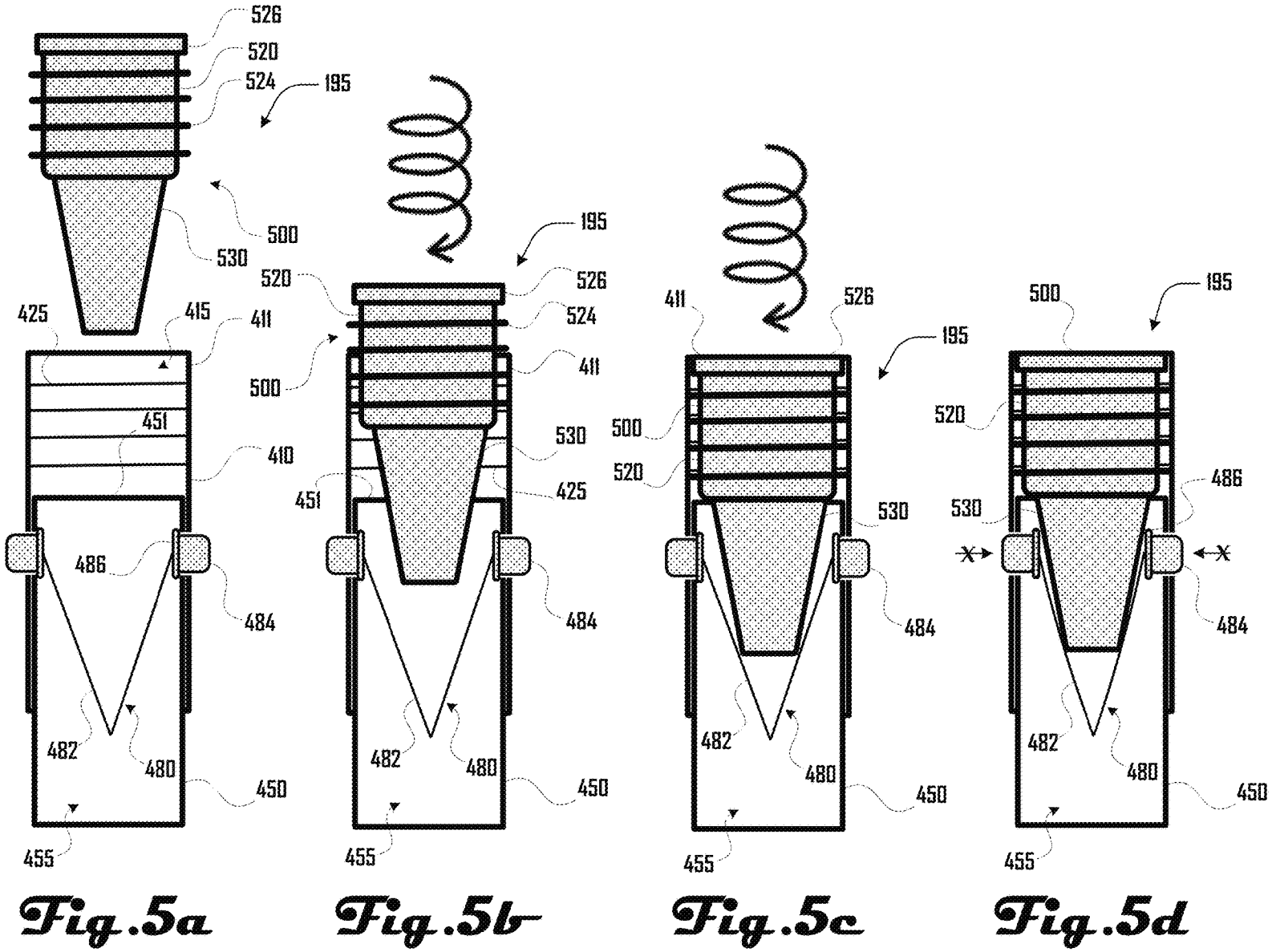
FIG. 5*a* is an example cross-sectional view of a locking assembly comprising a stopper 500.
FIG. 5*b* is an example cross-sectional view of the locking assembly of FIG. 5*a* where the stopper is disposed within a cavity of first and second portions of the locking assembly.
FIG. 5*c* is an example cross-sectional view of the locking assembly of FIGS. 5*a* and 5*b* where the stopper is disposed within a cavity of first and second portions of the locking assembly and the stopper is flush with a top of the first portion.
FIG. 5*d* is an example cross-sectional view of the locking assembly of FIGS. 5*a*, 5*b* and 5*c* illustrating how the stopper in this example can prevent movement of tabs of a push pin to lock the first and second portions of the locking assembly together.

For example, FIGS. 5*a-d* illustrate stopper 500 comprising a head portion 520 that includes stopper threads 524 and a cap 526. The stopper 500 further comprises a nose 530, which in this example has a truncated conical shape. As shown in FIG. 5*b*, the stopper 500 can be inserted into the engaged, coupled or locked configuration of the first and second bodies 410, 450 via the stopper being inserted into the first body cavity 415 at the first end 411 of the first body 410 and into the second body cavity 455 at the first end 451 of the second body 450. The stopper threads 524 can engage the first body threads 425 and the stopper 500 can be rotated to further extend the stopper into the first and second body cavities 415, 455 as shown in FIGS. 5*b* and 5*c*.

As shown in FIGS. 5*c* and 5*d*, in various embodiments the stopper 500 can be rotated until at least flush with the first end 411 of the first body 410 such that the cap 526 is at least flush with the first end 411 of the first body 410. In various embodiments, the stopper 500, stopper threads 524 and/or first body threads 425 can be configured such that the stopper 500 ceases to be further rotatable once the stopper 500 is at least flush with the first end 411 of the first body 410.

As shown in FIGS. 5*c* and 5*d*, in various embodiments the nose 530 of the stopper 500 can be configured to be disposed proximate to or engaging the spring 482 and/or tabs 484 of the push pin 480 such that the tabs 484 of the push pin 480 are physically prevented by the nose 530 from being fully pushable or retractable within the first body coupling holes 420 and second body tab holes 460. For example, as shown in the examples of FIGS. 5*c* and 5*d*, when the stopper 500 is screwed flush with the first end 411 of the first body 410, the nose 530 of the stopper 500 is positioned such that if the tabs 484 are squeezed by a user, the tabs 484 may move a bit as shown in FIG. 5*d*, but are physically prevented by the nose 530 from being fully pushable or retractable within the first body coupling holes 420 and second body tab holes 460 such that the first and second bodies 410, 450 are locked together and prevented from being disengaged, de-coupled or un-locked.

While one example of a stopper 500 is shown herein, it should be clear that a stopper 500 of various embodiments can have any suitable configuration. For example, the nose 530 may or may not be truncated and may or may not be flat at the end. Also, in some examples, the peripheral edges of the cap 526 can share a plane with the stopper threads 524 of the stopper 500, but in some examples can be greater or smaller in size. Also, while the stopper 500 in some embodiments can be configured to be rotated flush with, or below flush with the first end 411 of the first body 410, in some embodiments, the stopper 500 can be configured to engage the top of the first end 411 of the first body 410. Additionally, the stopper 500 can be suitably configured based on different configurations or types of push pins 480 or other locking mechanisms.

Figure 6A:
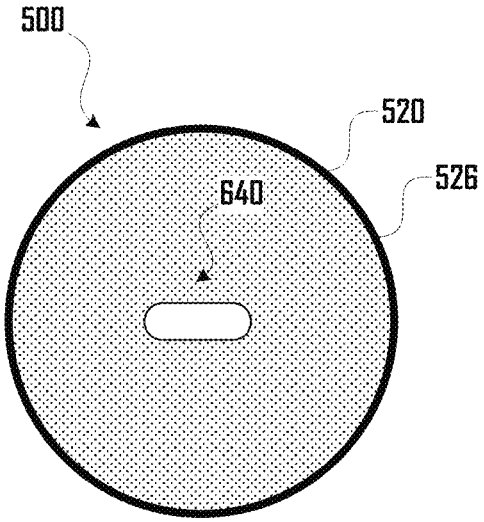
FIG. 6*a* illustrates a key slot in the top of a stopper in accordance with an embodiment.
Figure 6B:
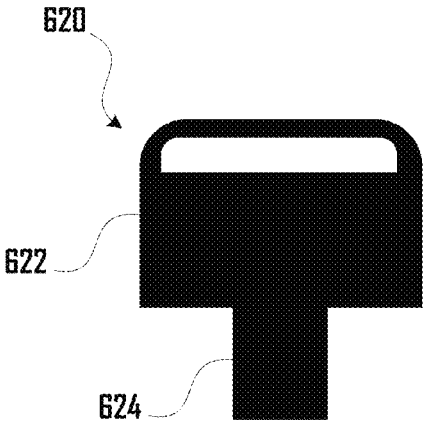
FIG. 6*b* illustrates a key in accordance with an embodiment.
Figure 6C:
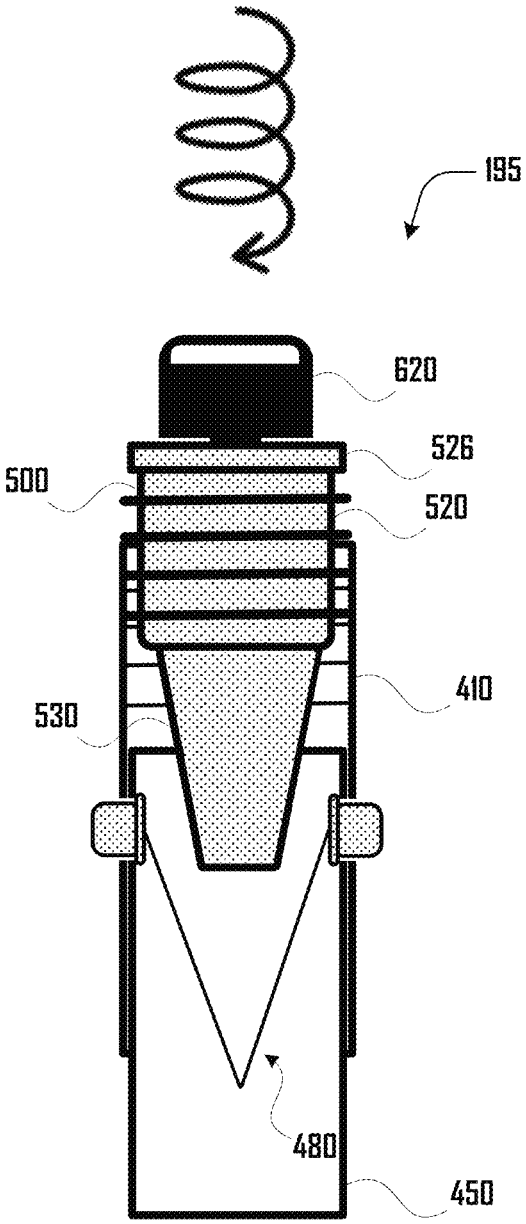
FIG. 6*c* illustrates a key in accordance with an embodiment being used to rotate a stopper of a locking assembly.

Turning to FIGS. 6*a*, 6*b* and 6*c*, in some embodiments a key 620 can be used to screw the stopper 500 into the first end 411 of the first body 410. For example, a key 620 as shown in FIG. 6*b* can comprise a bow 622 and a blade 624, with the blade 624 being configured to removably couple with a key slot 640 on the top of the stopper 500 as shown in FIGS. 6*a* and 6*c*. In some examples, the key slot 640 and blade 624 can have a corresponding rectangular shape, which can allow a user to turn the key 620 via the bow 622 to rotate the stopper 500 into the first end 411 of the first body 410. In various embodiments, a key 620 can be necessary or desirable to rotate the stopper 500 at least flush with top of the first end 411 of the first body 410 because a user may not be able to grasp edges of the stopper 500 to rotate it and it can be desirable in various embodiments to not have elements extending from the top of the stopper 500. Also, it should be clear that the key slot 640 and blade 624 of the key 620 can have any suitable shape(s) that allow for rotation of the stopper 500 via the key 620, so the specific examples of FIGS. 6*a*, 6*b* and 6*c* should not be construed as limiting.

Additionally, while various embodiments relate to one or more locking assemblies 195 being part of a rail assembly 100 that can be disposed in or about a bed to be used as a hand rail, it should be clear that further embodiments can employ one or more locking assemblies 195 in any suitable rail assembly used for various purposes and in various locations. Also, in some embodiments a locking assembly 195 can be employed in various suitable systems that comprise cylindrical components that mate. Accordingly, the specific examples herein should not be construed as limiting on the wide variety of further embodiments in which a locking assembly 195 can be employed.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives. Additionally, elements of a given embodiment should not be construed to be applicable to only that example embodiment and therefore elements of one example embodiment can be applicable to other embodiments. Additionally, elements that are specifically shown in example embodiments should be construed to cover embodiments that comprise, consist essentially of, or consist of such elements, or such elements can be explicitly absent from further embodiments. Accordingly, the recitation of an element being present in one example should be construed to support some embodiments where such an element is explicitly absent.

What is claimed is:

1. A rail assembly configured to be disposed between a mattress and a bed frame of a bed to provide a handrail for a user of the bed, the rail assembly comprising:

a first bar assembly that is planar along a first bar assembly plane, the first bar assembly including:

a first U-bar that includes a first U-bar end from which a pair of first U-bar sides extend perpendicular to a central axis of the first U-bar end, a first H-bar that includes:

a first H-bar beam with a pair of first H-bar locking tubes coupled on opposing ends of the first H-bar beam, and a pair of first H-bar coupling tubes respectively coupled to the first H-bar locking tubes on an opposing side of where the first H-bar beam is coupled to the first H-bar locking tubes, the first H-bar locking tubes and first H-bar coupling tubes disposed in parallel to each other and perpendicular to a central axis of the first H-bar beam, the first H-bar coupling tubes coupled with respective ends of sides of the first U-bar;

a second bar assembly that is planar along a second bar assembly plane, the second bar assembly including:

a second U-bar comprising a second U-bar end from which a pair of second U-bar sides extend perpendicular to a central axis of the second U-bar end of the second U-bar, a second H-bar that includes:

a second H-bar beam with a pair of second H-bar locking tubes coupled on opposing ends of the second H-bar beam, and a pair of second H-bar coupling tubes respectively coupled to the second H-bar locking tubes on an opposing side of where the second H-bar beam is coupled to the second H-bar locking tubes, the second H-bar locking tubes and second H-bar coupling tubes disposed in parallel to each other and perpendicular to a central axis of the second H-bar beam, the second H-bar coupling tubes coupled with respective ends of sides of the second U-bar;

a first and second L-bar which are removably coupled to the first bar assembly and removably coupled to a second bar assembly, with the first and second L-bar holding the first and second bar assemblies such that the first and second bar assembly planes are perpendicular to each other; and four locking assemblies defined at least in part by the first and second L-bars and the first and second bar assemblies, with each locking assembly comprising:

a first body that is defined by or is part of, one of the first or second H-bar locking tubes, the first body being a cylindrical tube that extends between a first end and second end and defines a first body cavity and a pair of first body coupling holes on opposing sides of the first body, the first body comprising first body threads at the first end, a second body that is defined by or is part of one of the first or second L-bars, the second body being a cylindrical tube that extends between a first end and second end and defines a second body cavity and a pair of second body tab holes on opposing sides of the second body, the second body having an external diameter that is equal to or slightly smaller than an internal diameter within the first body cavity of the first body such that the first end of the second body can be inserted into the first body cavity at the second end of the first body with a close fit, a push pin disposed within the second body cavity, with the push pin comprising:

a spring, the spring being V-shaped with a pair of arms, and a pair of tabs that include a base flange, the tabs respectively coupled at ends of the arms of the spring, the spring biasing the tabs outward away from each other and disposed within the second body cavity such that the tabs are configured to respectively extend through the first body coupling holes and through the second body tab holes and are stopped by the base flanges, which causes the first and second bodies to be locked together, and a stopper configured to lock the push pin such that the tabs of the push pin are physically prevented from being fully pushable or retractable within the first body coupling holes and second body tab holes such that the first and second bodies are prevented from being disengaged, de-coupled or un-locked via actuating the tabs of the push pin, the stopper comprising a head portion that includes stopper threads, and a cap, the stopper further comprising a conical nose, the stopper configured to be inserted into the first body cavity at the first end of the first body and into the second body cavity at the first end of the second body with the stopper threads engaging the first body threads such that the stopper can be rotated to further extend the stopper into the first and second body cavities, the stopper configured to be disposed proximate to or engaging the spring and/or tabs of the push pin such that the tabs of the push pin are physically prevented by the conical nose from being fully pushable or retractable within the first body coupling holes and second body tab holes such that the first and second bodies are locked together and prevented from being disengaged, de-coupled or un-locked via actuating the push pin.

2. The rail assembly of claim 1, wherein the stopper is configured to be rotated until the stopper is at least flush with a top of the first end of the first body such that the cap is at least flush with or within the first end of the first body, and wherein the stopper, stopper threads and/or first body threads are configured such that the stopper ceases to be further rotatable once the stopper is at least flush with or within the first end of the first body.

3. The rail assembly of claim 1, wherein the first U-bar comprises a set of one or more pads disposed on the first U-bar sides that comprise textured plates that provide points of friction engagement or coupling to a mattress or pad that the first U-bar is disposed under.

4. The rail assembly of claim 1, further comprising a strap assembly coupled to the first U-bar end of the first U-bar.

5. A rail assembly, the rail assembly comprising:

a first bar assembly that is planar along a first bar assembly plane;

a second bar assembly that is planar along a second bar assembly plane;

a first and second L-bar which are removably coupled to the first bar assembly and removably coupled to a second bar assembly, with the first and second L-bar holding the first and second bar assemblies such that the first and second bar assembly planes are perpendicular to each other; and a plurality of locking assemblies defined at least in part by two or more of the first and second L-bars and the first and second bar assemblies, with each locking assembly comprising:

a first body, the first body being a cylindrical tube that extends between a first end and second end and defines a first body cavity and a pair of first body coupling holes, the first body comprising first body threads at the first end, a second body, the second body being a cylindrical tube that extends between a first end and second end and defines a second body cavity and a pair of second body tab holes, a push pin disposed within the second body cavity, with the push pin comprising:

a spring with a pair of arms, and a pair of tabs, the tabs respectively coupled at ends of the arms of the spring, the spring biasing the tabs outward away from each other and disposed within the second body cavity such that the tabs are configured to respectively extend through the first body coupling holes and through the second body tab holes, which causes the first and second bodies to be locked together, and a stopper configured to lock the push pin such that the tabs of the push pin are physically prevented from being fully pushable or retractable within the first body coupling holes and second body tab holes such that the first and second bodies are prevented from being disengaged, de-coupled or un-locked via actuating the tabs of the push pin, the stopper comprising a head portion that includes stopper threads, and a cap, the stopper further comprising a nose, the stopper configured to be inserted into the first body cavity at the first end of the first body and into the second body cavity at the first end of the second body with the stopper threads engaging the first body threads such that the stopper can be rotated to further extend the stopper into the first and second body cavities, the stopper configured to be disposed proximate to or engaging the spring and/or tabs of the push pin such that the tabs of the push pin are physically prevented by the nose from being fully pushable or retractable within the first body coupling holes and second body tab holes such that the first and second bodies are locked together and prevented from being disengaged, de-coupled or un-locked via actuating the push pin.

6. The rail assembly of claim 5, wherein the first bar assembly comprises:

a first U-bar that includes a first U-bar end from which a pair of first U-bar sides extend perpendicular to a central axis of the first U-bar end, a first H-bar that includes:

a first H-bar beam with a pair of first H-bar locking tubes coupled on opposing ends of the first H-bar beam, and a pair of first H-bar coupling tubes respectively coupled to the first H-bar locking tubes on an opposing side of where the first H-bar beam is coupled to the first H-bar locking tubes, the first H-bar locking tubes and first H-bar coupling tubes disposed in parallel to each other and perpendicular to a central axis of the first H-bar beam, the first H-bar coupling tubes coupled with respective ends of sides of the first U-bar.

7. The rail assembly of claim 5, wherein the second bar assembly includes:

a second U-bar comprising a second U-bar end from which a pair of second U-bar sides extend perpendicular to a central axis of the second U-bar end of the second U-bar, a second H-bar that includes:

a second H-bar beam with a pair of second H-bar locking tubes coupled on opposing ends of the second H-bar beam, and a pair of second H-bar coupling tubes respectively coupled to the second H-bar locking tubes on an opposing side of where the second H-bar beam is coupled to the second H-bar locking tubes, the second H-bar locking tubes and second H-bar coupling tubes disposed in parallel to each other and perpendicular to a central axis of the second H-bar beam, the second H-bar coupling tubes coupled with respective ends of sides of the second U-bar.

8. The rail assembly of claim 5, wherein the second body has an external diameter that is equal to or slightly smaller than an internal diameter within the first body cavity of the first body such that the first end of the second body can be inserted into the first body cavity at the second end of the first body with a close fit.

9. The rail assembly of claim 5, wherein the spring is V-shaped.

10. A rail assembly, the rail assembly comprising: one or more locking assemblies, with each locking assembly comprising: a first body that defines a first body cavity and a pair of first body coupling holes, the first body comprising first body threads, a second body that defines a second body cavity and a pair of second body tab holes, a push pin disposed within the second body cavity, with the push pin comprising: a spring, and a pair of tabs, the tabs disposed within the second body cavity such that the tabs are configured to respectively extend through the first body coupling holes and through the second body tab holes, which causes the first and second bodies to be locked together, and a stopper configured to be disposed proximate to or engaging the spring and/or tabs of the push pin such that the tabs of the push pin are physically prevented from being fully or partially pushable or retractable within the first body coupling holes and second body tab holes such that the first and second bodies are locked together and prevented from being disengaged, de-coupled or un-locked via the push pin; wherein the stopper is configured to be inserted into the first body cavity at a first end of the first body with stopper threads engaging the first body threads such that the stopper can be rotated to further extend the stopper into the first body cavity.

11. The rail assembly of claim 10, further comprising:

a first bar assembly that is planar along a first bar assembly plane;

a second bar assembly that is planar along a second bar assembly plane; and a first and second L-bar which are removably coupled to the first bar assembly and removably coupled to a second bar assembly, with the first and second L-bar holding the first and second bar assemblies such that the first and second bar assembly planes are perpendicular to each other, wherein the one or more locking assemblies are defined at least in part by one or more of the first and second L-bars and the first and second bar assemblies.

12. The rail assembly of claim 10, wherein the first body comprises a cylindrical tube that extends between a first end and second end.

13. The rail assembly of claim 10, wherein the second body comprises a cylindrical tube that extends between a first end and second end.

14. The rail assembly of claim 10, wherein the spring comprises a pair of arms and wherein the tabs are respectively coupled at ends of the arms of the spring.

15. The rail assembly of claim 10, wherein the spring biases the tabs outward away from each other.

16. The rail assembly of claim 10, wherein the stopper comprises:

a head portion that includes stopper threads and a cap, and a nose.

17. The rail assembly of claim 16, wherein tabs of the push pin are physically prevented by the nose from being fully pushable or retractable within the first body coupling holes and second body tab holes such that the first and second bodies are locked together.

18. The rail assembly of claim 10, wherein the stopper is configured to be inserted into the first body cavity at a first end of the first body and into the second body cavity at a first end of the second body.

* * * * *